US007559432B2

(12) United States Patent
Mavin et al.

(10) Patent No.: US 7,559,432 B2
(45) Date of Patent: Jul. 14, 2009

(54) CLOSURE WITH FRANGIBLE MEMBRANE

(75) Inventors: Gerry Mavin, Ashington (GB); Timothy Stephenson, Doncaster (GB); Stephen Glover, Doncaster (GB)

(73) Assignee: Portola Packaging Limited, Doncaster, South Yorkshire (GB)

( * ) Notice: Subject to any disclaimer, the term of this patent is extended or adjusted under 35 U.S.C. 154(b) by 150 days.

(21) Appl. No.: 11/021,548

(22) Filed: Dec. 21, 2004

(65) Prior Publication Data

US 2006/0000793 A1 Jan. 5, 2006

(30) Foreign Application Priority Data

Dec. 22, 2003 (GB) ..... 0329727.2

(51) Int. Cl.
*B65D 41/32* (2006.01)
*B65D 51/22* (2006.01)

(52) U.S. Cl. ..... 220/258.2; 220/270; 215/256; 222/541.9

(58) Field of Classification Search ..... 220/258.2, 220/276, 270, 254.8, 258.1; 215/253, 232, 215/298, 305, 256; 222/541.9
See application file for complete search history.

(56) References Cited

U.S. PATENT DOCUMENTS

| | | | | |
|---|---|---|---|---|
| 3,239,112 A | | 3/1966 | Porcelli | |
| 5,735,426 A | | 4/1998 | Babcock et al. | |
| 5,810,207 A | * | 9/1998 | Hayashida | 222/153.07 |
| 5,915,574 A | * | 6/1999 | Adams et al. | 215/45 |
| 2001/0015355 A1 | | 8/2001 | Adams et al. | |

FOREIGN PATENT DOCUMENTS

| | | |
|---|---|---|
| EP | 0 337 484 A1 | 10/1989 |
| FR | 2 736 329 A1 | 7/1995 |
| GB | 2374068 A | 2/2001 |
| JP | 09-20360 A | 1/1997 |
| JP | 2001-171715 A | 6/2001 |
| JP | 2003-321043 A | 11/2003 |
| WO | WO 99/51428 A1 | 10/1999 |

OTHER PUBLICATIONS

Patent Abstracts of Japan, May 30, 1997, vol. 1997, No. 05 (JP 09-20360 A).
Patent Abstracts of Japan, Feb. 10, 2001, vol. 2000, No. 23 (JP 2001-171715 A).
Patent Abstracts of Japan, Dec. 5, 2003, vol. 2003, No. 12 (JP 2003-321043 A).

* cited by examiner

*Primary Examiner*—Anthony D Stashick
*Assistant Examiner*—James N Smalley
(74) *Attorney, Agent, or Firm*—James P. Hanrath; Adam K. Sacharoff

(57) ABSTRACT

There is described a closure comprising a wall defining an aperture and a membrane frangibly connected to the wall and closing the aperture. The frangible connection between the membrane and the wall lies in a plane which is inclined to a plane perpendicular to an axis of the aperture.

9 Claims, 11 Drawing Sheets

CLOSURE WITH FRANGIBLE MEMBRANE

The present invention relates to a closure having a frangible membrane.

In the specification which follows the problems of fluid packaging will be discussed with particular reference to the problems associated with the packaging of milk. However, it will be appreciated that other potable fluids such as water and fruit juices present similar packaging problems.

Conventionally, milk has been packaged in blow-moulded plastics containers which are provided with resealable caps. The resealable caps are typically formed of injection moulded plastics material. There is however, a fundamental problem in achieving a good seal between a blow-moulded plastics container and an injection moulded plastics cap. This is because the tolerance of the neck of the container may be of the order of ±0.3 mm whereas the tolerance of an injection moulded item, such as the cap, is typically ±0.1 mm. This means that it is inevitable that a proportion of the caps made to a particular specification will not seal tightly when fitted to the necks of the containers for which they are intended. This in turn leads to production difficulties in applying the caps to the container necks and leakage problems for both retailers and distributors of the packaged product.

This problem is further exacerbated by the fact that the blow-moulded plastics containers are typically manufactured at a different location and by a different producer from the injection moulded plastics caps. This is because, although the containers could be supplied to the bottling plant ready made, this would inevitably result in the need to transport large volumes. It is therefore more usual for the blow-moulded containers to be produced in a blow-moulding plant adjacent the dairy so that they can be formed and filled on one continuous production line.

However, the consequence of having two parts, the container and the cap, which must co-operate if there is to be an adequate seal, manufactured by different parties and at different locations means that on those occasions when the sealing characteristics of a batch of containers is poor there is also a lack of accountability as to which of the container or the cap is responsible.

In order to address the problems of leakage, there have in recent years been proposed a large number of different designs of cap. For example, in one design, the cap is provided with a top and a downwardly extending skirt portion which depends from the top. The skirt portion is provided on an inner surface with one or more threads for engagement with one or more complimentary threads provided on an outer surface of the container neck. A downwardly depending annular plug is provided on an underside of the top, spaced radially inwardly of the skirt. The plug is dimensioned to engage a rim of the container opening defined by the neck so as to form a primary seal. A secondary seal may be provided by means of an annular bead or shoulder provided on the cap at or adjacent the intersection of the top and the depending skirt such that, upon application of the cap to the container neck, the bead or shoulder engages an external surface of the neck at a location above the threads. However, although commercially successful, this design of cap does not adequately address the fundamental problem of providing a reliable seal between a blow-moulded component and an injection moulded component. Instead, leakage rates have been reduced by providing ever increasing numbers of primary, secondary and sometimes even tertiary sealing surfaces. However, on occasion, the provision of so many seals can be counter productive and actually cause leakage rates to rise as the interrelated tolerances of the cap and neck result in clashes between the sealing surfaces.

Another design of closure is described in GB-A-2,374,068. In this document there is proposed a container comprising a blow-moulded plastics body and an injection moulded neck and cap assembly which can be fused to the body after the body has been filled with a fluid. In other words, the closure to the container comprises two parts, a neck and a cap, both of which may be injection moulded to the same tolerances. This enables the cap and neck, by virtue of their mutual cooperation, to provide a plurality of reliable sealing surfaces. At the same time, the injection moulded neck is permanently adhered to the blow-moulded plastics body so as to prevent any leakage between the two.

Initially, the injection moulded neck is formed with a membrane with which to close off the opening in the blow-moulded plastics body. However, this membrane may be removed and discarded by pulling on a pull-ring with which the membrane is provided. This allows access to be gained to the contents of the blow-moulded plastics body while the resealing capability of the closure is provided by the engagement of an annular plug provided on an underside of the cap with the bore of the injection moulded neck.

This two part closure design clearly has the potential to provide improved sealing characteristics. However, the use of the described injection moulded neck inevitably adds to the height of the packaged product as well as to the radial dimensions of the cap with which it must interengage. As a result, the use of such a closure necessitates the use of a dedicated bottling line which is adapted to handle containers of a non-standard height. Likewise, the use of a non-standard cap requires the adaptation of existing capping equipment. All this imposes a considerable burden on those responsible for the bottling plant and acts as a disincentive in moving from one design of closure to another despite the anticipated improvement in sealing characteristics that can be expected to result.

Therefore, although it is known to overcome the difficulties associated with providing a reliable resealable closure by abandoning the previous attempt to design an injection moulded cap capable of sealingly engaging with a blow-moulded container and replacing it with a two part assembly, both parts of which may be injection moulded with one part permanently adhered to the still blow-moulded container and the other part providing resealable engagement with the first part, nevertheless the problem of providing such an assembly which is capable of being applied using existing capping equipment still remains.

In particular, it would be desirable to provide a two part assembly which is capable of being used with a container having a standard silhouette and being of a conventional height. In this way there would be no need for the various stations on a bottling line to be specially adapted to accommodate a different shape or height of bottle. Likewise, it would also be desirable to provide a two part assembly in which the external dimensions of the cap, known as the cap silhouette, were the same as an existing industry standard. In this way, the two part assembly could be used with existing "pick and place" equipment and with existing capping machines, thereby removing the need for the bottling line to move over to new or different equipment simply to process a batch of containers having a different and otherwise highly desirable closure system. The present invention seeks to address these desires.

Accordingly there is described a closure for use with a container neck, the closure comprising a cap and an insert, the insert being adapted to be permanently adhered to the container neck and having a sealing surface and the cap comprising a complimentary sealing surface for sealable engagement with the sealing surface provided on the insert and engagement means for releasable engagement with complimentary engagement means provided on the container neck.

Advantageously the container neck may have a rim surrounding an axial bore and the insert may be adapted to be received within the bore, the insert having a flange adapted to project outwardly from the bore to overlie the surrounding rim such that the insert protrudes axially from the bore no more than the thickness of the flange. This provides the advantage of restricting the height of the insert above the container neck and so permits the use of a conventionally dimensioned cap.

Advantageously the container neck may have an external neck surface and the insert may be shaped such that no part of the insert overlies the external neck surface. This provides the advantage of restricting the dimensions of the insert in a plane perpendicular to the axis of the bore and so once again permits the use of a conventionally dimensioned cap.

There is also described a closure for use with a container neck, the container neck having a rim surrounding an axial bore and the closure comprising a cap and an insert, the cap having a sealing surface and the insert being adapted to be received within the bore and permanently adhered to the container neck and having a complimentary sealing surface for sealable engagement with the sealing surface provided on the cap and a flange, the flange being adapted to project outwardly from the bore to overlie the surrounding rim such that the insert protrudes axially from the bore no more than the thickness of the flange. This again provides the advantage of restricting the height of the insert above the container neck and so permits the use of a conventionally dimensioned cap.

Advantageously the cap may be provided with engagement means for releasable engagement with complimentary engagement means provided on the container neck.

Advantageously the container neck may have an external neck surface and the insert may be shaped such that no part of the insert overlies the external neck surface. This again provides the advantage of restricting the dimensions of the insert in a plane perpendicular to the axis of the bore and so once more permits the use of a conventionally dimensioned cap.

There is also described a closure for use with a container neck having an external neck surface, the closure comprising a cap and an insert, the cap having a sealing surface and the insert having a complimentary sealing surface for sealable engagement with the sealing surface provided on the cap, the insert being adapted to be permanently adhered to the container neck and shaped such that no part of the insert overlies the external neck surface. This again provides the advantage of restricting the dimensions of the insert in a plane perpendicular to the axis of a bore defined by the container neck and so once more permits the use of a conventionally dimensioned cap.

Advantageously the cap may be provided with engagement means for releasable engagement with complimentary engagement means provided on the container neck.

Advantageously the container neck may have a rim surrounding an axial bore and the insert may be adapted to be received within the bore, the insert having a flange adapted to project outwardly from the bore to overlie the surrounding rim such that the insert protrudes axially from the bore no more than the thickness of the flange. This again provides the advantage of restricting the height of the insert above the container neck and so once more permits the use of a conventionally dimensioned cap.

Advantageously the cap may comprise a top and a depending side wall, the engagement means being provided on an interior surface of the depending side wall. Advantageously the engagement means may comprise a helical thread configuration. Alternatively the engagement means may comprise a first formation adapted to be snapped over and held in position by a second retaining formation provided on the container neck.

Advantageously the bore may be cylindrical and the flange may be adapted to project radially outwardly from the bore. Advantageously the external dimension of the flange may be less than that of the rim it is adapted to overlie. Advantageously the flange may incorporate a pour lip. Advantageously the flange may be adapted to be permanently adhered to the container neck. Advantageously an undersurface of the flange may incorporate a recess for the receipt of a sealing medium with which to permanently adhere the insert to the container neck.

Advantageously the insert may be adapted to be wholly received within the external dimensions of the cap. Advantageously the cap may have the same silhouette as that of a conventional cap thereby enabling the closure to be applied using existing capping equipment.

Advantageously the container neck may define a bore and the insert may comprise a wall adapted to be received within the bore, an interior surface of the wall defining the sealing surface provided on the insert and an exterior surface of a plug provided on the cap defining the complimentary sealing surface provided on the cap. Preferably the bore and wall are cylindrical and the plug provided on the cap is annular.

Advantageously the insert may be provided with a removable membrane with which to close off the container neck. Preferably the removable membrane may be at least in part defined by a frangible line of weakness and may be provided with a pull-ring with which to separate the membrane from the remainder of the insert. Advantageously at least a portion of the removable membrane may be concave.

Advantageously both the cap and the insert may comprise injection moulded plastics components.

There is also described a closure in combination with a container having a container neck, the closure being as previously described. Advantageously the container and container neck may be of a conventional design thereby enabling the container to be manipulated on a production line using existing equipment.

There is also described a closure in combination with a container having a container neck defining a bore, the closure comprising a cap and an insert, the insert being permanently adhered to the container neck and comprising a wall received within the bore and the cap comprising a plug which sealingly engages with an interior surface of said wall at a location within the container neck. This provides the advantage of enabling the strength of the container neck to contribute towards the adequacy of the seal.

Advantageously, at the location of sealing engagement, the wall of the insert may be interposed between the plug and a surface of the container neck defining the bore. Advantageously the plug may be formed so as to not only sealingly engage with an interior surface of the wall but also to urge an external surface of the wall into sealing engagement with a surface of the container neck defining the bore. Advantageously the insert may be formed of low density polyethylene (LDPE) and the cap may be formed of high density polyethylene (HDPE). Advantageously the closure may have any of the additional features previously described.

Although the above described closure is a specific example, it is known to provide closures defining a bore with a membrane with which to close the bore. The bore is typically that through which the contents of the container are dispensed and the membrane is typically connected to a wall defining the bore by means of a frangible connection. In this way the connection between the membrane and the wall may be broken and the membrane discarded in order to gain access to the contents of the container. The membrane is typically provided with means, such as a pull-ring attached to the membrane, to enable a user to break the frangible connection and remove the membrane from the bore. The bore is typically of circular cross-section such that the membrane and the frangible connection lie in a radial plane. Furthermore, it is often desirable that the pull-ring adds as little as possible to the overall height of the closure with the result that the membrane is often located at a lower end of the bore closest to the body of the container and furthest from the pour lip.

One of the problems with membranes of this type is that the act of pulling the pull-ring in order to beak the frangible connection between the membrane and the surrounding wall can have the effect of pulling the surrounding wall inside out. This is particularly true in the case of those walls, such as that described above, which are not supported at an end adjacent the membrane and which are attached to the surrounding neck structure or to the remainder of the closure only at the opposite end. If the connection between the membrane and the surrounding wall is insufficiently frangible, in addition to turning the wall defining the bore inside out, continued pulling on the pull-ring may even act to separate the wall from the surrounding container and/or closure.

This disruption to the wall defining the bore can have a detrimental effect on the sealing qualities of the closure, particularly if the wall concerned additionally defines a sealing surface.

Another problem common to closures incorporating a membrane and pull-ring is that in order to provide sufficient room for a user to insert a finger under the annular band of the pull-ring, the annular band must be sufficiently spaced from the underlying membrane. This in turn means that the connection with which the annular band is joined to the membrane must be of a certain length. However, the longer the axial length of the connection, the greater is the risk that the connection will stretch upon use of the pull-ring. This in turn will mean that a user will have to exert excessive force in order to remove the membrane or at least to start to break the frangible connection between the membrane and the surrounding wall. Accordingly, it would be desirable to provide a closure in which breaking of the frangible connection between the membrane and the surrounding wall was more reliable and in which the risk of pulling the wall inside out was significantly reduced.

According to a first aspect of the present invention there is provided a closure comprising a wall defining an aperture and a membrane frangibly connected to the wall and closing the aperture, the fragible connection between the membrane and the wall lying in a plane which is inclined to a plane perpendicular to an axis of the aperture. The provision of an angled membrane prevents the wall from inverting when a force is applied to the membrane to break the frangible connection between the membrane and the wall.

Advantageously, the aperture may comprise a bore having opposite ends. Preferably, the opposite ends of the bore may occupy parallel planes. In this way, although the membrane is angled, when viewed from the side, a lower edge of the closure may be flat. This helps to prevent the occurrence of so called "cocked caps" which may occur if the lower edge was also to be angled.

Advantageously, means may be provided attached to the membrane with which to tear the membrane from the wall. Preferably, prior to use, this means may occupy a position wholly within the bore. Alternatively, or in addition, this means may be attached to a surface of the membrane facing one of the ends, the means being attached to a peripheral portion of the membrane at a location where the membrane is closest to that one end. In this way a force acting to remove the membrane from the bore is applied at a peripheral location where the axial height of the bore above the membrane is at a minimum. This in turn serves to minimise the risk of the wall to which the membrane is frangibly connected being pulled inside out.

Advantageously, the means attached to the membrane may comprise a pull-ring. Furthermore, the pull-ring may preferably comprise an annular band which extends axially between a plane perpendicular to an axis of the bore and a plane proximate the inclined plane occupied by the frangible connection. In this way, the surface area of the annular band may be maximised whilst at the same time not adding to the overall height of the closure.

Advantageously, the membrane may comprise a peripheral portion and a concave central portion. This provides sufficient room for a user to insert a finger under the pull-ring to open the closure. Preferably, the concave central portion may extend away from one of the ends of the bore but does not extend beyond a plane defined by the other of the ends. In this way, the concave nature of the central portion does not add to the overall height of the closure.

Advantageously, the wall defining the bore may be strengthened intermediate the membrane and the lower end of the bore. This strengthening may take the form of one or more ribs on an external surface of the wall defining the bore and prevents the material making up the wall from stretching as the frangible connection is broken. Advantageously, the bore may be of circular cross-section such that a plane perpendicular to the axis of the bore comprises a radial plane. Accordingly, the frangible connection between the wall and the membrane may define an ellipse.

Advantageously, the bore may decrease in internal diameter between an upper end of the bore and the membrane.

Advantageously, the closure may further comprise a cap having a sealing surface, the sealing surface being adapted to be received within one end of the bore to sealingly engage with the wall at a location intermediate the membrane and the one end.

An embodiment of the present invention will now be described by way of example with reference to the accompany drawings in which.

Figure 4:
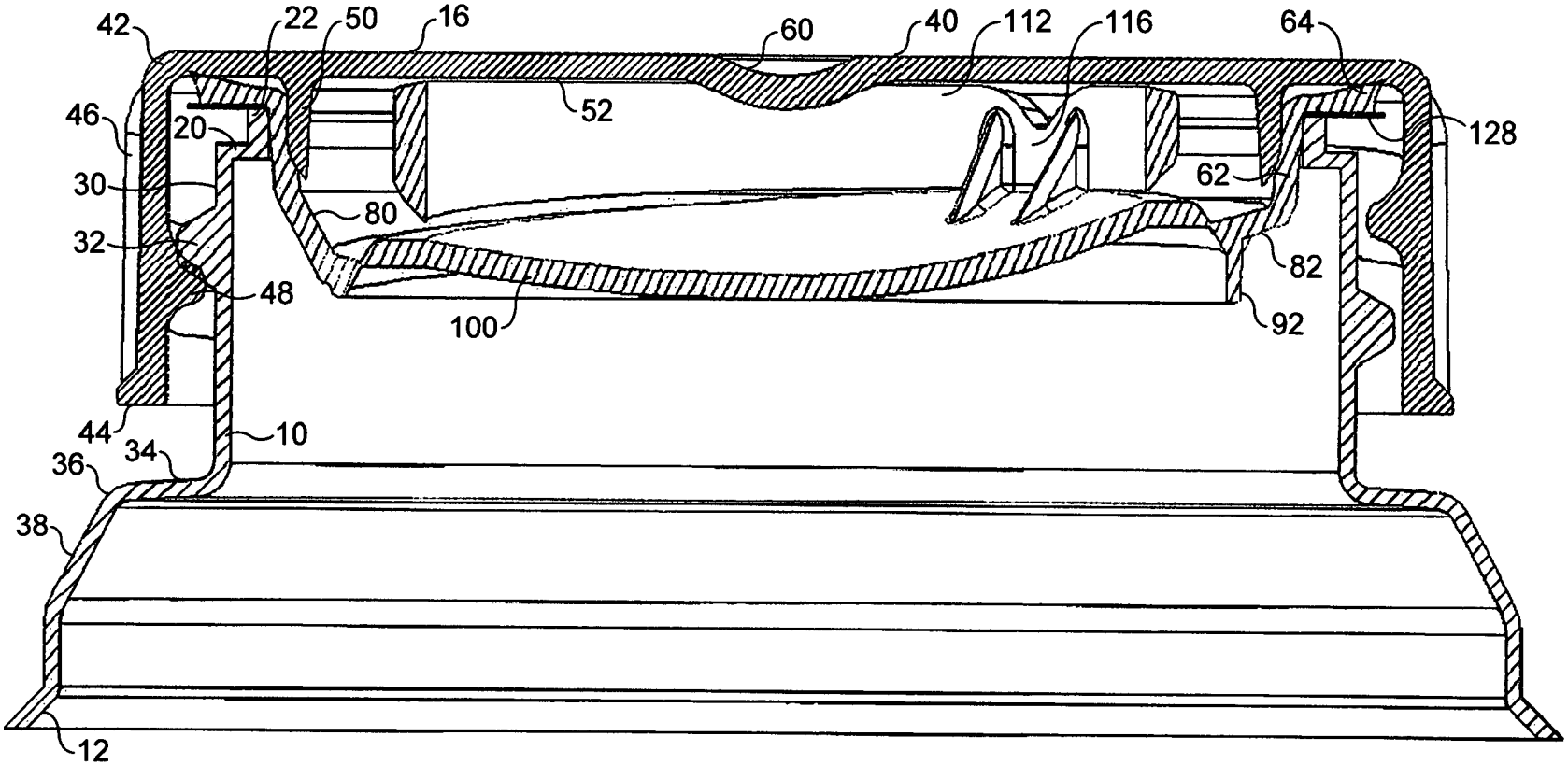
FIG. 4 is a cross-sectional view of the container neck of FIG. 1 with the closure applied to the container neck.
Figure 5:
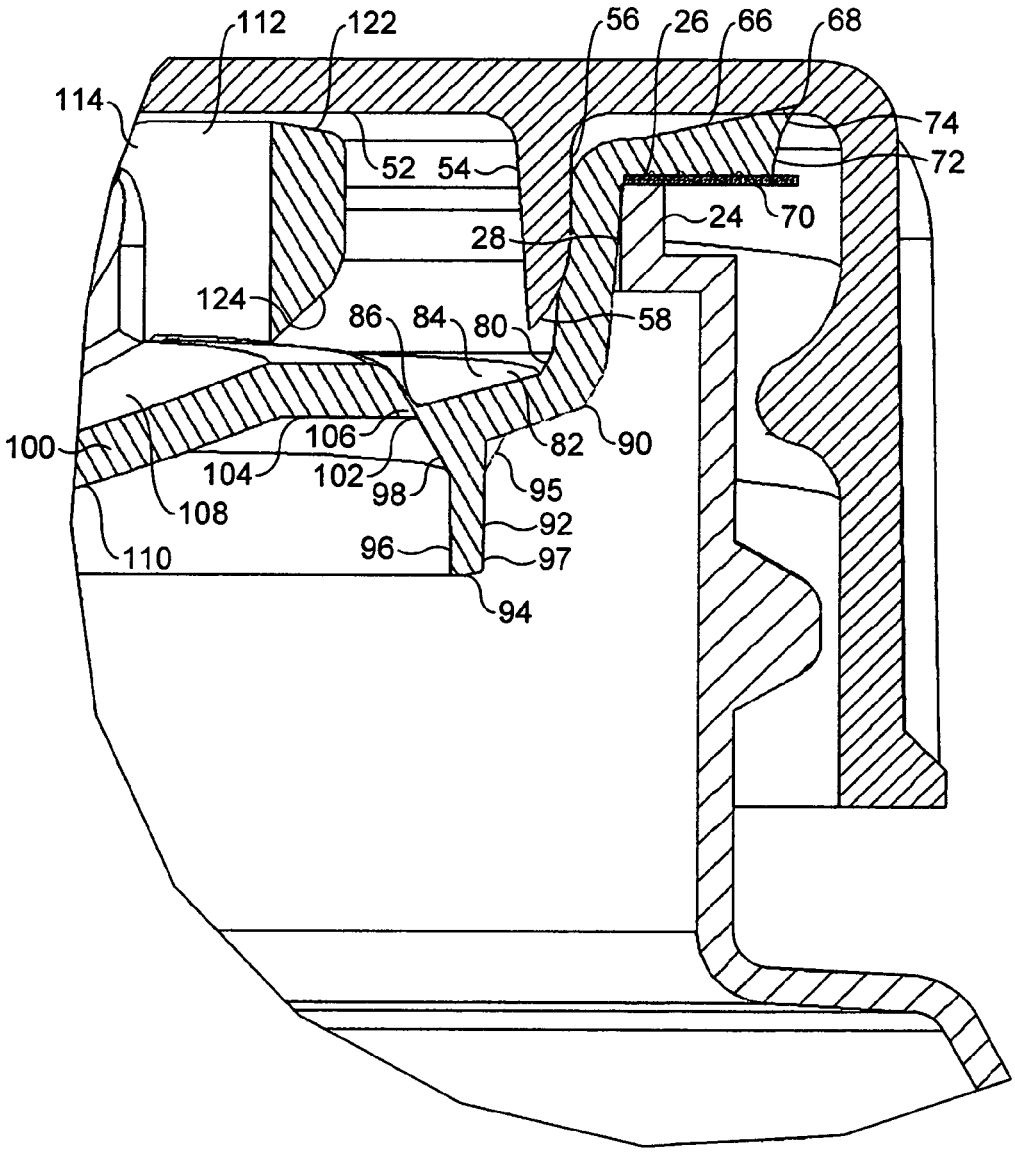
FIG. 5 is an enlarged cross-sectional view of a detail of FIG. 4.
Figure 6:
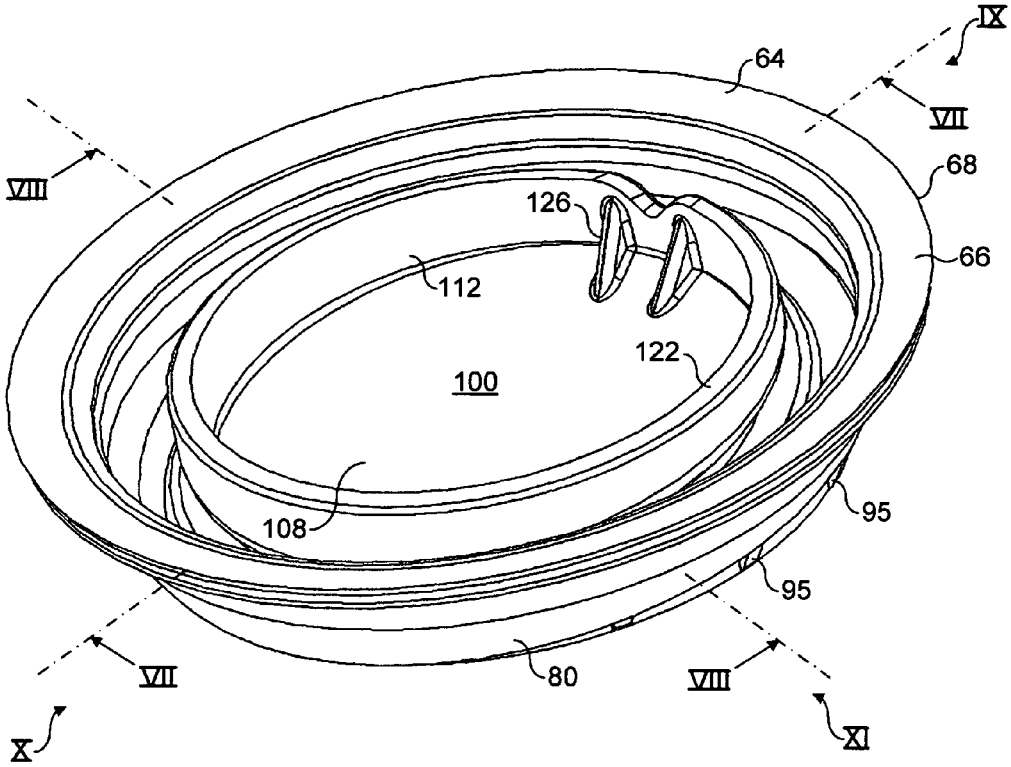
FIG. 6 is a perspective view of an insert forming part of the closure.

Referring to the accompanying drawings and in particular FIGS. 4 and 5 there is shown a neck 10 of a container 12, an insert 14 received within the neck 10, and a cap 16 which engages with both the neck 10 and the insert 14. Together, the insert 14 and cap 16 define a closure 18 for the container 12.

The container 12 may be of any conventional design. In particular, the body shape of the container 12 may take any suitable form and may, for example, be of square, rectangular or circular cross-section. Likewise, an integral handle may be formed as part of the body shape.

Figure 12:
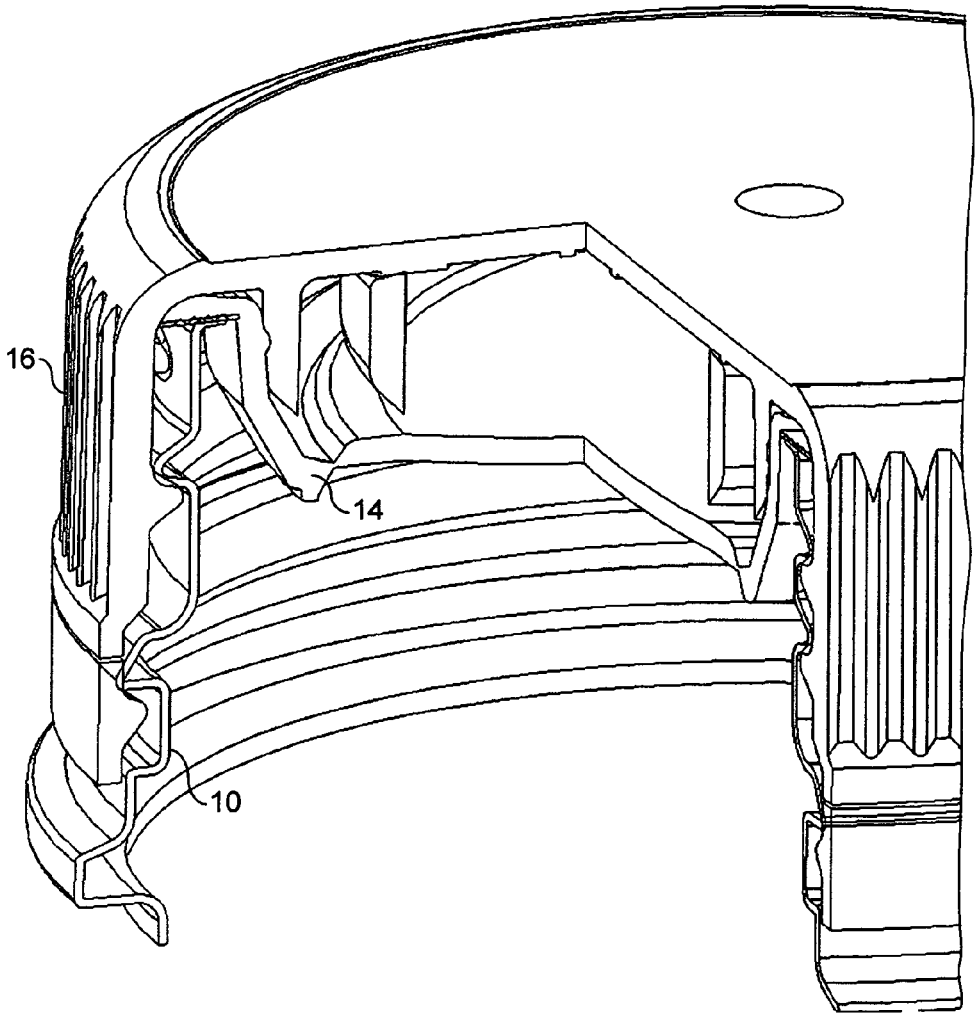
FIG. 12 is a cross-sectional view of an alternative design of container neck and showing an alternative design of cap, the alternative designs of neck and cap cooperating to provide the closure with a tamper evident capability.

The profile of the neck 10 is preferably also of a conventional design and may, for example as shown in FIG. 12, comprise a pull-up neck finish formed as a result of a blow pin being pulled up through an annular shear steel to create a neck opening having a relatively thin, but generally smooth, annular rim. Alternatively, the neck 10 may comprise a ram-down neck finish formed as a result of a technique in which a blow pin and cutting ring are rammed down through an annular shear steel to produce a neck opening which is surrounded by a much more rigid perimeter and which contains far more plastics material than its pull-up counterpart. As will be readily appreciated by those skilled in the art, the embodiment illustrated in FIGS. 3 to 5 shows a container 12 having just such a ram-down neck finish as evidenced by the characteristic annular wall which projects upwardly from a radially inner edge of the annular rim and which is known in the art as a chimney.

Figure 1:
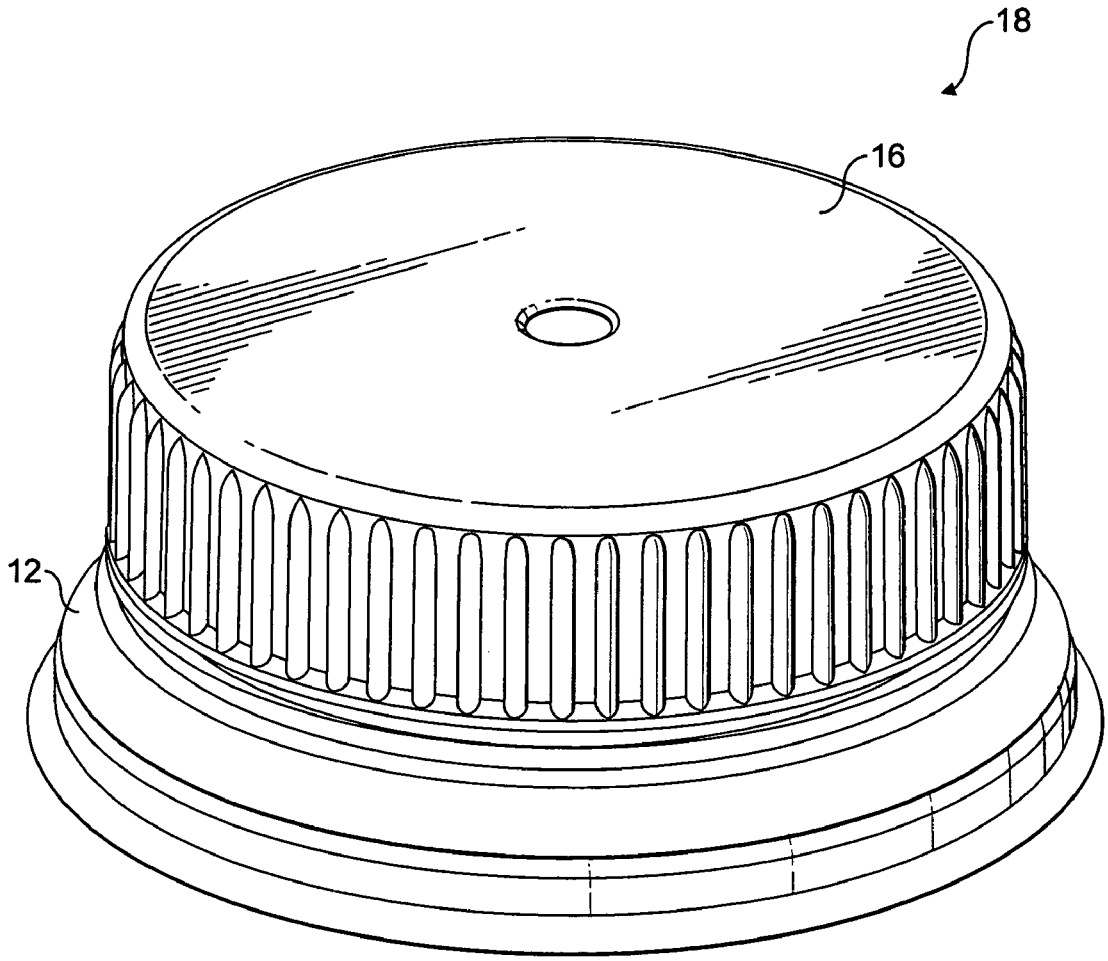
FIG. 1 is a perspective view of a container neck and a closure.
Figure 2:
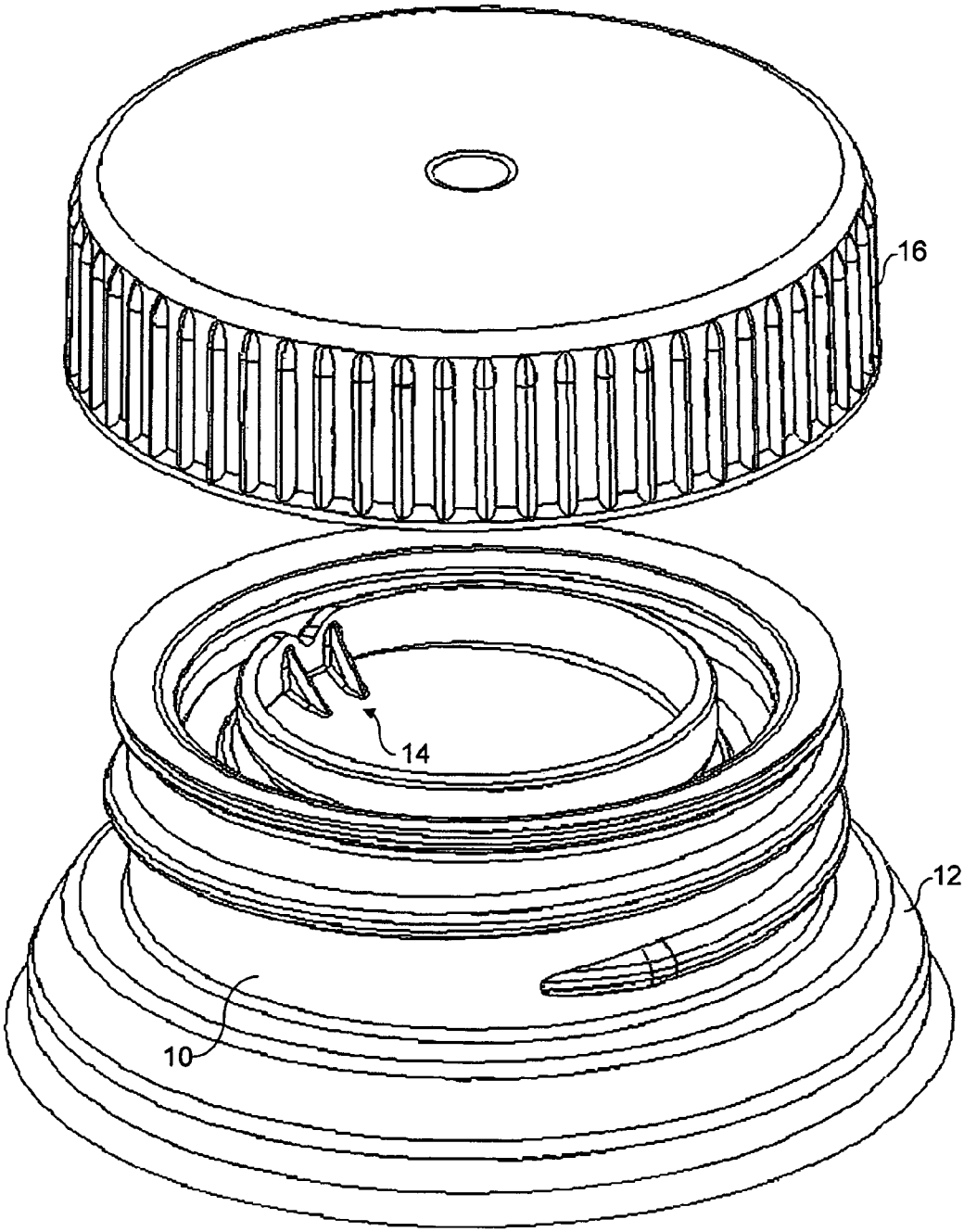
FIG. 2 is an exploded view of the container neck of FIG. 1 and showing the closure to comprise a cap and an insert received within the container neck.
Figure 3:
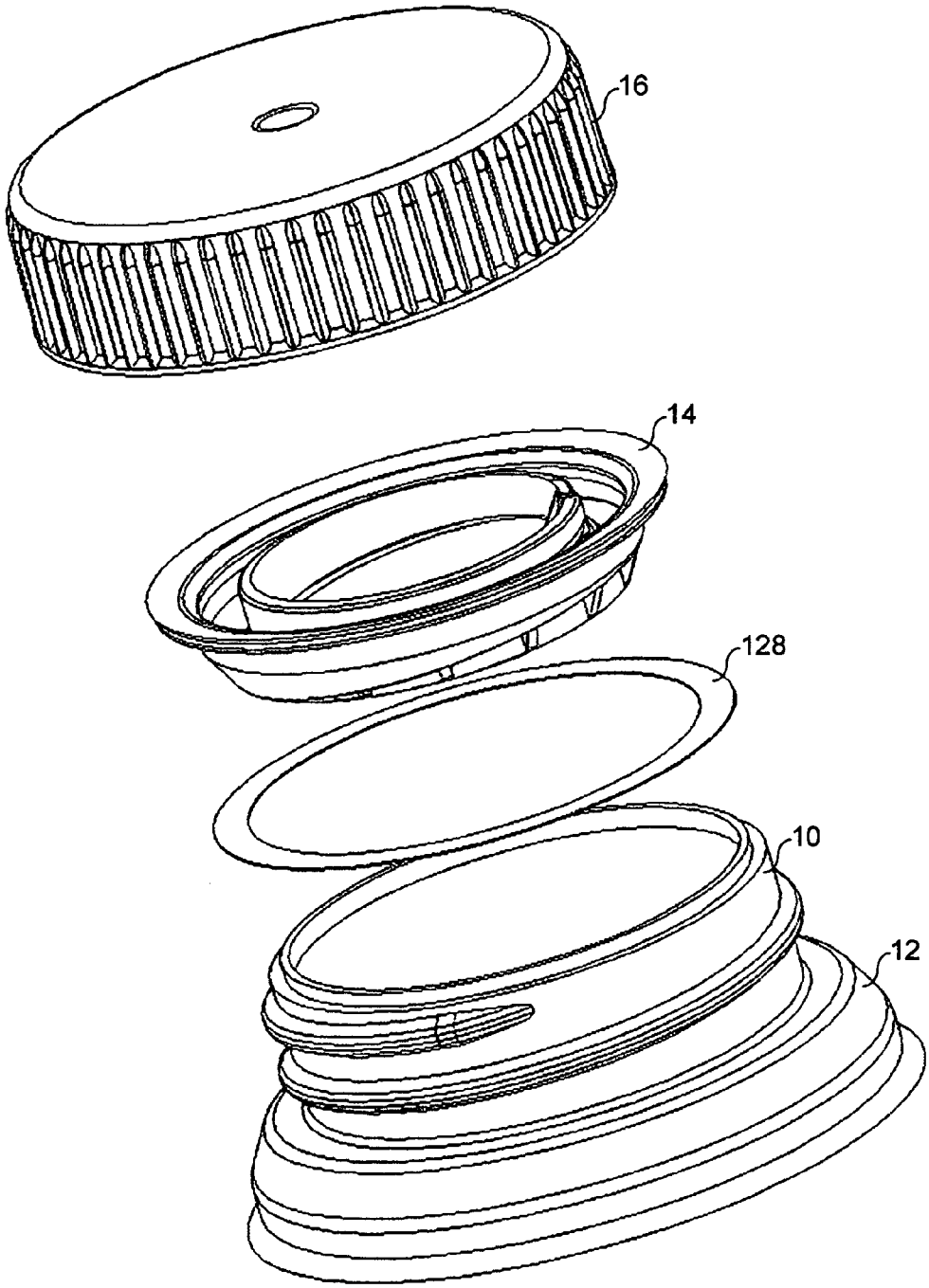
FIG. 3 is an exploded view of the container neck of FIG. 1 and showing the closure to comprise a cap, an insert and a sealing medium.

The profile of the neck 10 is shown in more detail in FIGS. 3 to 5 to comprise a radially extending rim 20 which merges, at a radially inner end, with the chimney 22. The chimney 22 is in turn defined by an upwardly extending, radially outer wall 24; an upper, generally horizontal surface 26; and a downwardly extending, radially inner wall 28.

At a radially outer end, the rim 20 merges with a downwardly extending neck stretch portion 30 which is provided, on an exterior surface, with engagement means 32 with which to engage complimentary engagement means provided on the cap 16. In the example shown, the engagement means 32 takes the form of a male helical thread configuration comprising a single start. It will be apparent however, that the engagement means 32 may take a number of different forms and, in particular, may not be limited to a single thread or lead but may comprise two, three, four or more threads as appropriate. For example, the engagement means may comprise five, six, seven or eight threads if so desired. Indeed, although not illustrated, for certain packaging requirements a plurality of threads may be preferable.

In the illustrated embodiment, the single thread extends approximately 450° around the circumference of the neck stretch portion 30. Once again however, it will be understood that threads of a lesser or greater extent may also be employed. For example, in a four start thread configuration, each thread may extend within a range from 90° to more than 360°.

Preferably the helical thread configuration has a fine thread density to limit the vertical float of the cap 16 on the neck 10. Thus, the thread density preferably lies within the range of between 6 and 12 threads per linear inch. Most preferably of all, is a thread density of approximately 8½ threads per linear inch.

Below the engagement means 32, the neck stretch portion 30 merges with a generally horizontal, radially extending wall 34. This generally horizontal, radially extending wall 34 merges, at a radially outer end, with an arcuate wall portion 36 before in turn merging with a downwardly and radially outwardly extending wall 38. The precise direction and extent of the downwardly and radially outwardly extending wall 38 are determined by the shape of the container 12 which, as stated previously, may be entirely conventional, and forms no part of the present invention.

Irrespective of the neck finish, the container 12 may be blow-moulded from high density polyethylene (HDPE) so as to have a typical wall thickness of between 0.1 mm and 1.0 mm. A container having a wall thickness of less than 0.1 mm is unlikely to have the necessary structural integrity to hold its shape when filled with fluid. For a milk container having a capacity of up to six pints (3.41 liters) a wall thickness of between 0.4 mm to 0.6 mm is preferred.

The cap 16 which forms part of the closure 18 preferably has a conventional silhouette. In other words, its external dimensions, for example, its height and diameter, are the same as those of existing caps and may therefore be handled using existing capping equipment.

As shown in FIGS. 4 and 5 the cap 16 comprises a circular top 40 which merges at a radially outer edge with a depending annular side wall 42. The depending annular side wall 42 terminates at an end remote from the circular top 40 in a generally horizontal annular surface 44 while, on an exterior surface, the depending annular side wall 42 is provided with a plurality of circumferentially spaced, vertically extending ribs 46 which serve as knurls to facilitate the gripping of the cap 16 by a user. In contrast, on a radially inner surface, the depending annular side wall 42 is provided with complimentary engagement means 48 for repeated and releasable engagement with the engagement means 32 provided on the neck 10. As before, this engagement means 48 may take many forms but, in the example shown, comprises a male helical thread configuration having a single start and a thread density of approximately 8½ threads per linear inch. Once again, however, it will be appreciated that the complimentary engagement means 48 need not be limited to a single thread or lead but may comprise two, three or four threads as appropriate. Indeed, the complimentary engagement means 48 may comprise five, six, seven or eight threads if so desired. Indeed, as with the engagement means 32, for some packaging requirements it may be preferable for the complimentary engagement means 48 to comprise a plurality of threads.

In the illustrated embodiment the single thread extends about 450° around the inner surface of the depending annular side wall 42. Once again however, it will be understood that threads of a lesser or greater extent may also be employed. For example, in a four start thread configuration, each thread may extend within a range from 90° to more than 360°.

Likewise, although a thread density of approximately 8½ threads per linear inch is preferred, so as to limit the vertical float of the cap 16 with respect to the neck 10, nonetheless the thread density may differ from this figure. Preferably however, the thread density lies within a range of between 6 and 12 threads per linear inch.

As will be apparent to those skilled in the art, if one of the engagement means 32 or 48 comprises a male helical thread configuration, then the other of the two engagement means may comprise a helical groove configuration.

The two thread configurations 32 and 48 may be shaped so as to slip past one another and engage when a direct, axial downward force is applied to the cap 16 urging the cap into engagement with the neck 10. In other words, when the cap 16 is pushed onto the neck 10, the thread 48 on the cap snaps over and engages the thread 32 on the neck. This may be made possible by appropriate shaping of the threads 32 and 48, for example, by forming the threads with an asymmetric cross-section or by making them less pronounced. Alternatively, if it is desired to rotate the cap 16 onto the neck 10, the threads may be of symmetrical, as opposed to asymmetrical cross-section and may be more pronounced.

In addition to the complimentary engagement means 48, the interior of the cap 16 is also provided with an annular plug 50 which depends from an undersurface 52 of the circular top 40 and is spaced radially inwardly of the depending annular side wall 42. The annular plug 50 is defined by respective radially inner and outer walls 54 and 56, the radially outer plug wall 56 merging at an end remote from the circular top 52 with a generally downward and radially inwardly directed surface 58. This downwardly and radially inwardly directed surface 58 intersects the radially inner plug wall 54 and, together, serves to provide the annular plug 50 with a bevelled radially outer surface and a tapering cross-section. This tapering cross-section is further accentuated by the fact that, whereas the radially outer plug wall 56 extends in a direction substantially perpendicular to the plane of the undersurface 52, the radially inner plug wall 54 extends from the undersurface 52 in a direction which is both downwardly and radially outwardly.

Elsewhere, as it common with a number of caps, a small downwardly directed dimple 60 is formed in the centre of the circular top 40 so that any flash left after the cap 16 has been moulded does not project above a plane defined by the upper surface of the circular top 40.

The insert 14 which is received within the neck 10 of the container 12 is defined, in part, by a generally downwardly extending cylindrical wall 62. At an upper end, the generally downwardly extending cylindrical wall 62 merges with a radially outwardly extending annular flange 64. This annular flange 64 is defined by an upper flange surface 66 which slopes upwardly and radially outwardly before terminating in an annular pour lip 68 and by a generally radially outwardly extending lower flange surface 70. The upper and lower flange surfaces 66 and 70 are joined at an end remote from the generally downwardly extending cylindrical wall 62 by a peripheral surface 72 which extends generally upwardly from the lower flange surface 70 before merging with an upwardly and radially outwardly extending surface 74 which meets the upper flange surface 66 at the pour lip 68 and defines with the upper flange surface an acute included angle $\alpha$. Because the pour lip 68 is defined by the intersection of two surfaces, neither of which lies in a radial plane or in a circumferential surface at right angles to the radial plane, the pour lip provides improved dispensing of the contents of the container 12.

Although not shown, the lower flange surface 70 may be provided with an annular recess 76 which extends from a radially outer surface of the generally downwardly extending cylindrical wall 62 and is bound, at an end of the annular flange 64 remote from the cylindrical wall 62, by a downwardly depending annular lip 78.

Figure 7:
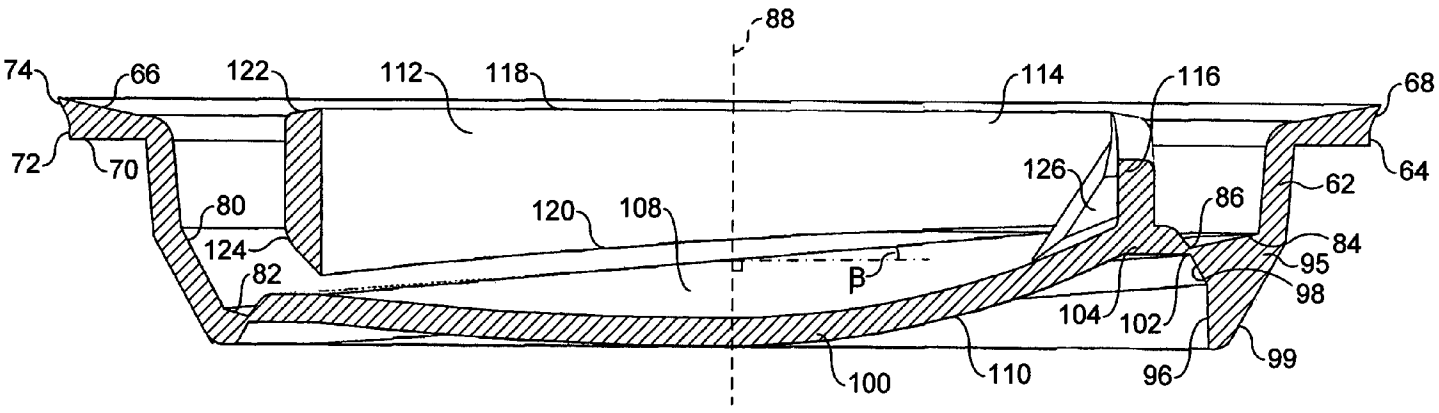
FIG. 7 is a cross-sectional view of the insert of FIG. 6 taken along lines VII-VII.
Figure 8:
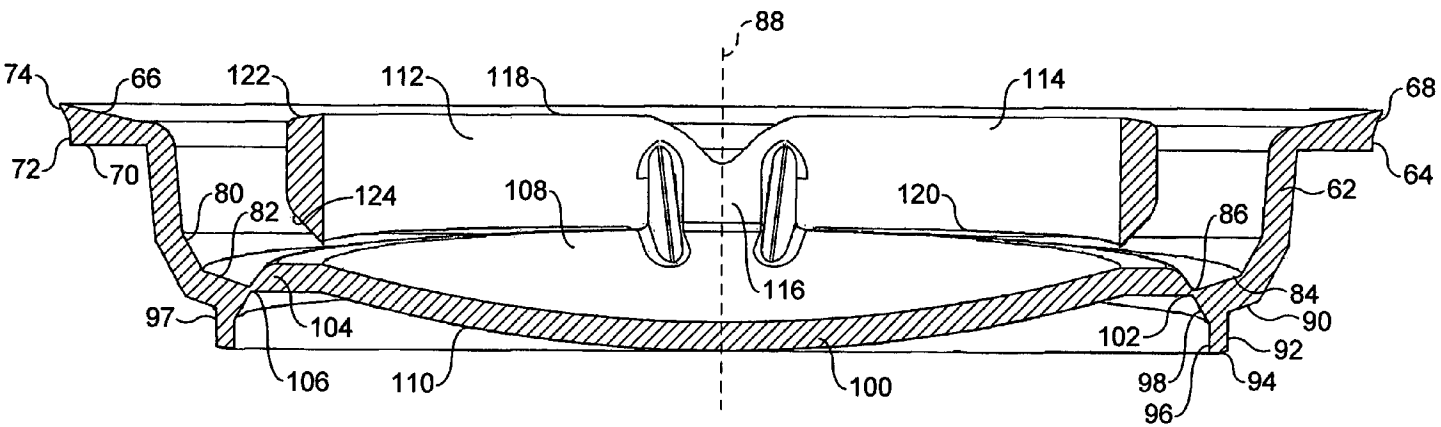
FIG. 8 is a cross-sectional view of the insert of FIG. 6 taken along lines VIII-VIII.
Figure 9:
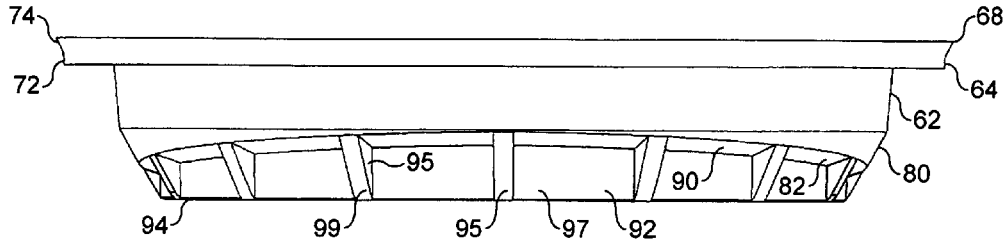
FIG. 9 is a lateral side view of the insert of FIG. 6 viewed in the direction of arrow IX.
Figure 10:
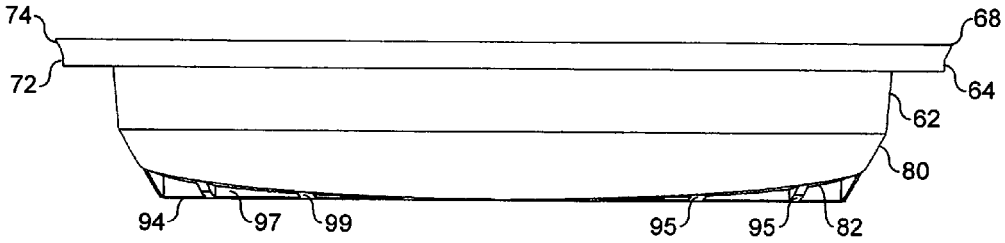
FIG. 10 is a lateral side view of the insert of FIG. 6 viewed in the direction of arrow X.
Figure 11:
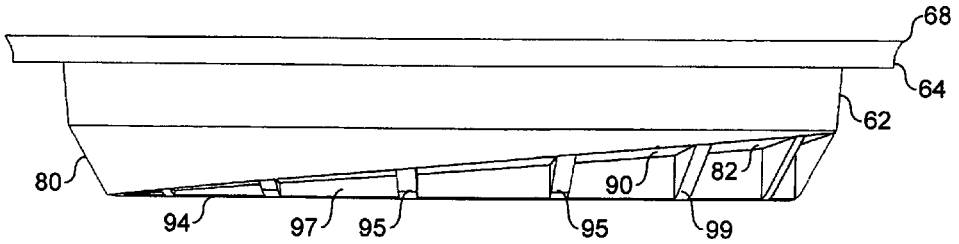
FIG. 11 is a lateral side view of the insert of FIG. 6 viewed in the direction of arrow XI.

Although extending generally downwardly, the cylindrical wall 62 also extends slightly radially inwardly in a direction away from the annular flange 64. At an end remote from the annular flange 64, the cylindrical wall 62 merges with a first annular, downwardly and radially inwardly inclined wall 80 which in turn merges with a second annular, downwardly and radially inwardly inclined wall 82. The first and second annular walls 80 and 82 subtend an obtuse included angle with the second annular wall being less downwardly and more radially inwardly inclined than the first such that a radially inner surface 84 of the second annular wall 82, although downwardly and radially inwardly inclined, nevertheless lies close to a radial plane. The first and second annular walls 80 and 82 have different extents at different circumferential locations around the cylindrical wall 62. Nevertheless, the two combine such that a radially inner edge 86 of the radially inner surface 84 lies in a cylindrical surface concentric with the insert axis 88. Thus, at one location around the cylindrical wall 62 (to the right in FIG. 7), the extent of the first annular downwardly and radially inwardly inclined wall 80 is reduced to zero while the extent of the second annular downwardly and radially inwardly inclined wall 82 is at a maximum while, at a diametrically opposite location (to the left in FIG. 7), the extent of the first annular downwardly and radially inwardly inclined wall 80 is at a maximum while the extent of the second annular downwardly and radially inwardly inclined wall 82 is at a minimum. The result of this is that the junction between the first and second annular walls 80 and 82 describes an ellipse which occupies a plane which is transverse to the insert axis 88 and is inclined at a shallow angle $\beta$ with respect to a radial plane. Likewise, the radially inner edge 86 of the radially inner surface 84 is similarly inclined with respect to a radial plane.

At an end of the second annular, downwardly and radially inwardly inclined wall 82 remote from the first there depends, from a radially outer surface 90, a downwardly extending cylindrical wall 92. This cylindrical wall 92 is also of varying extent having a maximum where the first annular wall 80 is at a minimum and reducing to zero at the diametrically opposite location where the extent of the first annular wall 80 is at a maximum. As a result the downwardly extending cylindrical wall 92 terminates in an annular surface 94 which occupies a radial plane perpendicular to the insert axis 86. A plurality of circumferentially spaced, generally radially disposed buttresses 95 extend between a radially outer surface 97 of the downwardly extending cylindrical wall 92 and the radially outer surface 90 of the second annular, downwardly and radially inwardly inclined wall 82. The buttresses 95 serve to strengthen the downwardly extending cylindrical wall 92 and are defined, in part, by a respective inclined surface 99 that extends from the junction between the annular surface 94 and the radially outer surface 97 of the downwardly extending cylindrical wall 92 on the one hand to the junction, on the exterior surface of the insert, between the first and second annular, downwardly and radially inclined walls 80 and 82 on the other. In so doing, the inclined surfaces 99 occupy the same conical surface as that defined by an exterior surface of the first annular, downwardly and radially inwardly inclined wall 80 with which they subsequently smoothly merge.

By contrast, a radially inner surface 96 of the downwardly extending cylindrical wall 92 extends upwardly from the annular surface 94 before merging with an upwardly and radially inwardly inclined surface 98. This upwardly and radially inwardly inclined surface 98 meets the radially inner surface 84 of the second annular wall 82 at the aforementioned radially inner edge 86 and subtends with the radially inner surface an acute included angle γ.

The ellipse defined by the radially inner edge 86 in plan view, when viewed along the insert axis 88, appears as a circle concentric with the insert axis. Furthermore, this circle would define an aperture but for the provision of a membrane 100 which spans the interior of the insert 14 and is joined to the radially inner edge 86 by means of a narrow web 102. The membrane itself is defined by a generally annular peripheral portion 104 which is joined to the second annular downwardly and radially inwardly inclined wall 82 at a lower, radially outer edge 106 and a central, circular concave portion 108. However, the concavity of the central circular portion 108 is not symmetrical about the insert axis 88. Rather, the concavity of the central circular portion 108 is greater in those regions close to where the downwardly extending cylindrical wall 92 has its greatest extent and shallower in those regions close to where the extent of the cylindrical wall 92 is at a minimum. As a result an undersurface 110 of the membrane 100, although perhaps touching, does not extend through the radial plane occupied by the annular surface 94.

A pull-ring 112, defined by an annular band 114, merges with the membrane 100 via a connection 116. The connection 116 merges with the membrane 100 at a location radially inward of, and adjacent to, the web 102 such that the pull-ring 112 is joined to the annular peripheral portion 104 of the membrane as opposed to the central, circular concave portion 108. Importantly, however, the connection 116 merges with the membrane 100 at a circumferential location at which the web 102 is at its highest point. In other words, at a location shown to the right in FIG. 7 where the extent of the first annular downwardly and radially inwardly inclined wall 80 is reduced to zero and where the extents of the second annular downwardly and radially inwardly inclined wall 82 and the downwardly extending cylindrical wall 92 are both at a maximum. Nevertheless, the pull-ring 112 is sized so as to be located within the insert 14 and below a plane defined by the annular pour lip 68. In order to maximise the axial dimensions of the pull-ring 112, the annular band 114 preferably extends between an upper edge 118 lying in a radial plane close to that defined by the annular pour lip 68 and a lower edge 120 which occupies a plane transverse to the insert axis 88 and close to that defined by the radially inner edge 86 and the web 102. In order to provide a comfortable surface, devoid of sharp edges, for a user's finger to pull against, the annular band 114 is preferably also provided with radiused upper and lower external surfaces 122 and 124 respectively. The concave nature of the central, circular portion 108 facilitates the gripping of the pull-ring by creating an increased void below the annular band 114 while, at the same time, reducing the effects of shrinkage on the membrane tear-line defined by the narrow web 102. As illustrated, the connection 116 between the annular band 114 and the membrane 100 may be strengthened by the provision of a pair of reinforcing gussets 126.

In order to assemble the closure 18 comprising the insert 14 and cap 16 to the container 12 a sealing medium 128 is applied to the lower surface 70 of the radially outwardly extending annular flange 64 of the insert 14. The sealing medium 128 may be extruded, sprayed, painted or otherwise applied. However, in a preferred embodiment, the sealing medium 128 has sufficient structural integrity to form an annular ring which can be received within the annular recess 76 if this should be provided. For example, the sealing medium 128 may comprise an electrically conductive substrate coated on opposed surfaces with respective first and second layers of an adhesive. The electrically conductive substrate may be formed of any of the materials conventionally used for providing a heat seal in existing plastics containers and may, for example, comprise a metallic foil such as an aluminium foil. Likewise, the layers of adhesive may be of any commercially available type which is capable of bonding with the surrounding plastics material once activated by, for example, the application of heat.

Thus, in this embodiment, the first step in assembling the closure 18 is to assemble the insert 14 and the sealing medium 128. This may be achieved either by inserting the generally downwardly extending cylindrical wall 62 through the central aperture of the annular ring or else by inverting the insert 14 and pressing the annular ring over the generally downwardly extending cylindrical wall 62. In either case, the assembly is facilitated by both the slight radially inward extension of the generally downwardly extending cylindrical wall 62 and by the radially inwardly directed nature of the first annular wall 80 and the inclined surfaces 99 of the buttresses 95. Although in a preferred embodiment (not shown) the sealing medium 128 is received within the annular recess 76, nonetheless it is preferably retained in place by means of a friction fit with a radially outer surface of the generally downwardly extending cylindrical wall 62. Thus the provision of the recess 76 and the downwardly depending annular lip 78 is preferably for cosmetic purposes only and serves to conceal the presence of the sealing medium 128 rather than to retain it in position. Indeed, in some embodiments, such as that illustrated, the recess 76 and the downwardly depending annular lip 78 may be omitted.

Having assembled the insert 14 and sealing medium 128, the two are then assembled to the cap 16. The cap 16 is offered up to the insert 14 and, in so doing, the annular plug 50 is received within the blind bore defined by the generally downwardly extending cylindrical wall 62. The receipt of the annular plug 50 in this way is facilitated by the bevelled nature of the plug as a result of the generally downward and radially inward directed surface 58. Nonetheless, the annular plug 50 is so positioned as to be required to flex radially inwardly in order to be received within the aforementioned blind bore. In this way, once the annular plug 50 has been fully received, the resilience of the material forming the plug causes the radially outer wall 54 to be urged into sealing engagement with the inner surface of the generally downwardly extending cylindrical wall 62.

It will be noted that the limit to which the annular plug 50 can be received within the blind bore defined by the generally downwardly extending cylindrical wall 62 is determined by the engagement of the upper surface 66 of the radially outwardly extending annular flange 64 with the undersurface 52 of the circular top 40. However, even in the fully received position, the pull-ring 112 is positioned such that it remains spaced from and does not abut the cap 16.

The closure 18, comprising the insert 14 and cap 16 as well as the sealing medium 128, is now fully assembled. However, all of the components are received within the cap 16 with the result that the external dimensions of the closure 18 are the same as those of the cap 16 which, as stated previously, may be entirely conventional. As a result the assembled closure 18 may be manipulated and applied using conventional processing and capping equipment.

To assemble the closure 18 to the container 12 the container is first filled with the desired contents. Because the container 12 may be of a conventional design, this filling step may be performed using existing equipment, as may its subsequent processing elsewhere along the production line. Once the container 12 has been filled, the assembled closure 18 is offered up to the neck 10 in such a way that the first and second annular, downwardly and radially inwardly inclined walls 80 and 82 of the insert 14 are received within the bore defined by the downwardly extending, radially inner wall 28 of the chimney 22. Continued downward pressure of the closure 18 onto the neck 10 causes the downwardly extending, radially inner wall 28 of the chimney 22 to slide along the radially outer surface of the generally downwardly extending cylindrical wall 62 until such time as the upper, generally horizontal surface of the chimney 26 engages the sealing medium 128. In so doing, as the downwardly extending, radially inner wall 28 nears the end of its travel, so the annular plug 50 is once again caused to flex radially inwardly to accommodate both the annular plug 50 and the generally downwardly extending cylindrical wall 62 within the bore defined by the chimney 22. As before, the radial inward flexing of the annular plug 50 is facilitated by the generally downward and radially inward directed surface 58 while the resilience of the material forming the annular plug 50 ensures that, afterwards, the annular plug is not only urged into sealing engagement with the inner surface of the generally downwardly extending cylindrical wall 62 but also that the outer surface of the generally downwardly extending cylindrical wall 62 is urged into sealing engagement with the downwardly extending, radially inner wall 28 of the chimney 22.

At the same time as the insert 14 is received within the bore defined by the chimney 22, so the depending annular side wall 42 of the cap 16 passes over the downwardly extending neck stretch portion 30. This brings the engagement means 32 into engagement with the complimentary engagement means 48. As stated previously, these two engagement means 32 and 48 may be shaped so as to slip past one another when a direct, axially downward force is applied to the cap 16 urging the cap into engagement with the neck 10. In other words, as the closure 18 is pushed onto the container 12, so the threads on the cap 16 snap over and engage the threads on the neck 10.

In an alternative embodiment the threads on the cap 16 and the threads on the neck 10 may be shaped so as to require the closure 18 to be rotated onto the container 12. Nonetheless, the generally downwardly extending cylindrical wall 62 of the insert 14 is still fully received within the bore defined by the downwardly extending, radially inner wall 28 of the chimney 22.

Once the closure 18 has been fully applied to the container 12, the assembled closure and container are exposed to a time varying magnetic field which gives rise to eddy currents within the electrically conductive substrate of the sealing medium 128 with the resultant generation of heat. This heat in turn activates the layers of adhesive and bonds the radially outwardly extending annular flange 64 to the upper, generally horizontal surface 26 of the chimney 22. If necessary, some pressure may be applied to hold the closure 18 firmly against the container 12 during the bonding process.

Although the sealing medium 128 has been described as comprising two layers of a heat-activated adhesive, one on each side of the central electrically conductive substrate, it will be apparent that the insert 14 and neck 10 may nevertheless be permanently bonded together using only a single layer of heat-activated adhesive provided that sufficient adhesive is present within the annular space defined between the cooperating parts of the fitment and neck and provided that the adhesive is capable of flowing into contact with the surfaces defining that space. To that end, the electrically conductive substrate may be provided with one or more apertures to permit the flow of adhesive from one side of the substrate to the other.

In another embodiment the sealing medium 128 may comprise a sealing compound, and in particular may comprise a pressure adhesion compound such that, upon application of a closing pressure to either the closure 18 or the container 12, the insert 14 is permanently bonded to the neck 10. Alternatively, the sealing medium 128 may be a compound which is activated when exposed to microwave radiation. In yet another currently preferred embodiment, the sealing medium 128 is a composition that permanently bonds the insert 14 to the neck 10 when the sealing compound is softened or melted by inductive and/or capacitive heating. To this end, once the closure 18 has been applied to the container 12, the assembled closure and container are exposed to a time varying magnetic field in the case of inductive heating or a time varying electric field in the case of capacitive heating. In either case, heat is generated within an inductive and/or capacitive material contained within the composition. This heat is then transferred to the rest of the composition and the composition then either softens or melts so that it flows into more intimate contact with the surfaces of the annular space defined between the cooperating parts of the insert and neck structures. Upon cooling, the composition hardens to provide a permanent weld or seal that bonds the insert 14 to the neck 10.

Once the insert 14 has been adhered to the neck 10, the container 12 may be opened by unscrewing and removing the cap 16. This exposes the pull-ring 112 which may be gripped by a finger of the user and pulled. The force imparted to the annular band 114 is transferred, via connection 116, to the membrane 100 which tears away from the second annular downwardly and radially inwardly inclined wall 82 along the line of weakness defined by the narrow web 102. Once the pull-ring 112 and the membrane 100 to which it is attached has been discarded, the contents of the container 12 may be dispensed in the usual way.

To re-close the container 12, the cap 16 is simply presented to the neck 10 in such a way that the helical thread configuration 48 on the cap engages the helical thread configuration 32 on the neck. As the cap 16 is screwed home so the generally downward and radially inward directed surface 58 of the annular plug 50 engages the radially inner surface of the generally downwardly extending cylindrical wall 62. This causes the annular plug 50 to flex radially inwardly. Once the cap 16 has been fully applied to the neck 10, the resilience of the material forming the annular plug 50 ensures that the radially outer wall of the plug 56 is urged into sealing engagement with a radially inner surface of the generally downwardly extending cylindrical wall 62 and that a radially outer surface of the generally downwardly extending cylindrical wall 62 is urged into sealing engagement with the downwardly extending, radially inner wall 28 of the chimney 22.

Because both the insert 14 and cap 16 may be injection moulded and therefore made to the same tolerances, it is anticipated that a reliable reseal may be obtained every time and that, strictly speaking, no secondary seal is required. Nonetheless, a secondary seal may be provided radially outwardly of the chimney 22 at the point of engagement between the upper surface 66 of the radially outwardly extending annular flange 64 and the undersurface 52 of the circular top 40.

The cap 16 may be screwed on and off the neck 10 as many times as is required.

It will be noted that because the sealing medium 128 is located within a space which does not communicate with the interior of the container 12 there is little risk of the sealing medium tainting or otherwise affecting the contents of the container. Likewise, because the insert 14 is provided with a generally downwardly extending cylindrical wall 62 which sealingly engages against the downwardly extending, radially inner wall 28 of the chimney 22, there is little likelihood of the contents of the container leaking out past the sealing medium 128 between the insert 14 and the neck 10.

It will also be noted that because both the effective size of the container opening (defined by the radially inner edge 86 of the radially inner surface 84 of the second annular downwardly and radially inwardly inclined wall 80) and the annular pour lip 68 are both defined by the same injection moulded component, the relationship between the two can be optimised so as provide the optimum pouring angle whilst retaining a practical bore.

Whilst the application of the closure 18 has been described with reference to a ram-down neck finish, it will be understood that the present invention may also be applied to a pull-up neck finish. Indeed, the only difference between the two resides in the fact that, in the absence of the chimney 22, the sealing medium 128 serves to bond the underside of the radially outwardly extending annular flange 64 to the radially extending rim 20 rather than to the upper, generally horizontal surface 26. Nonetheless, the generally downwardly extending cylindrical wall 62 can still be received within the bore defined by the radially extending rim 20 where, as before, it will be in sealing engagement with both the radially extending rim 20 and the annular plug 50. Thus, in all material respects the closure 18 may be applied, opened and resealed to a ram-down neck finish as described above. In particular, it will be noted that, notwithstanding the absence of the chimney 22, the sealing medium 128 is still contained within an annular space which does not communicate with the interior of the container 12.

With containers having either a pull-up or ram-down neck finish the provision of a downwardly depending annular lip 78 serves to conceal the presence of a sealing medium 128.

Although in the embodiment described the closure 18 has not been provided with any tamper evidence capability, it will be understood that this could also be provided. Indeed, since one of the advantages of the present invention is that it may find use with conventional containers 12 and makes use of caps 16 having a conventional silhouette, if those conventional containers and caps incorporate tamper evidence means, then so to may the present invention. One such example is illustrated in FIG. 12.

Although the engagement means 32 provided on the neck 10 and the complimentary engagement means 48 provided on the cap 16 have been described in terms of a helical thread or groove configuration, nonetheless the two sets of engagement means 32 and 48 may simply comprise a snap-band and cooperating retaining bead. Alternatively, the engagement means 32, 48 may rely upon nothing more than a friction or interference fit. Under such circumstances the resulting cap may be presented as a push-on cap rather than of the screw-on variety.

Figure 13:
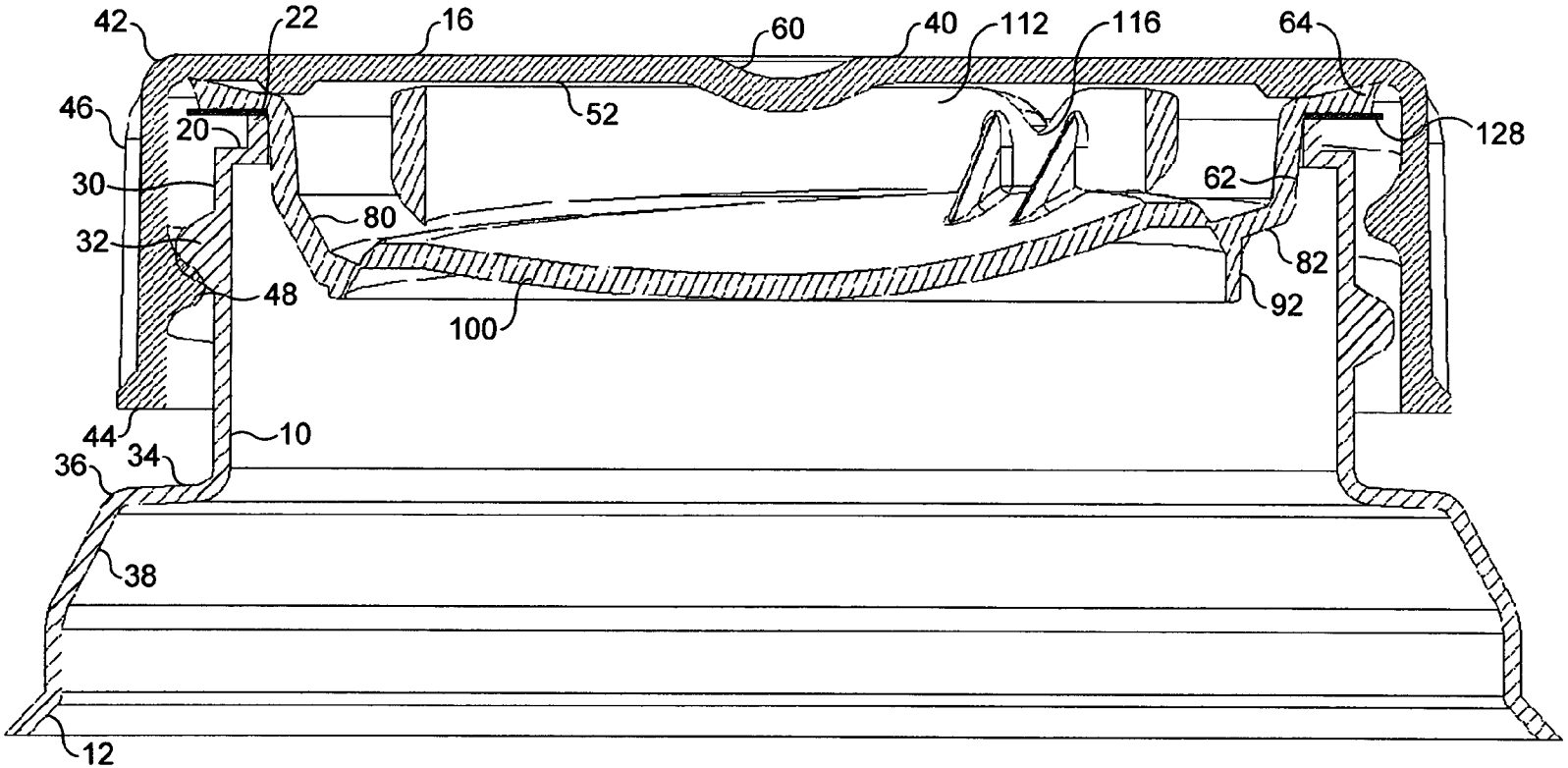
FIG. 13 is a cross-sectional view of the container neck and insert of FIG. 4 with an alternative design of cap.
Figure 14:
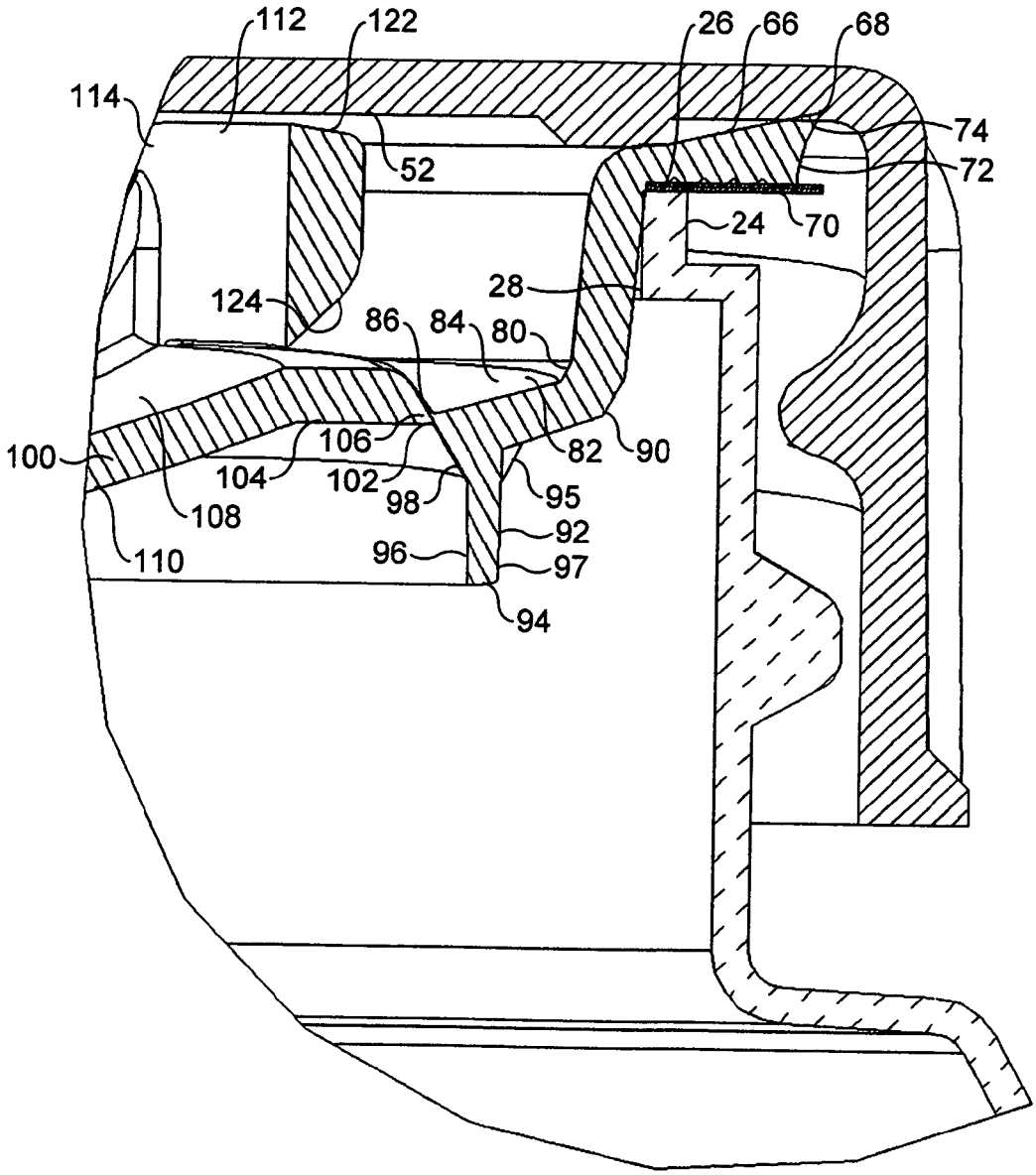
FIG. 14 is an enlarged cross-sectional view of a detail of FIG. 13.

Although in the embodiment described the cap 16 is provided with an annular plug 50 which depends from an under surface 52 of the circular top 40, this need not necessarily be the case. In the alternative embodiment illustrated in FIGS. 13 and 14 the plug 50 is replaced by an annular bead 130. The annular bead 130 depends from the under surface 52 of the circular top 40 such that, when the cap 16 is applied to the neck 10, the annular bead engages the upper flange surface 66 of the radially outwardly extending annular flange 64 to form a primary seal. It has been found that the engagement of the annular bead with the upper flange surface 66 is sufficient to prevent leakage of the contents of the container while dispensing with the annular plug 50 serves to both lighten the cap 16 and reduce the amount of raw material necessary to form the cap. However, in order to facilitate the assembly of the closure 18 and, in particular, to aid retention of the insert 14 within the cap 16, a series of radially inwardly projecting lugs (not shown) are preferably formed on a radially inner surface of the depending annular side wall 42 at a location above the complimentary engagement means 48. These radially inwardly projecting lugs are preferably circumferentially spaced in a radial plane perpendicular to the insert axis 88 and serve to engage either the sealing medium 128 or the radially outwardly extending flange 64 in an assembled closure, thereby preventing the insert 14 from being dislodged from the cap 16.

The invention claimed is:

1. A closure assembly comprising a wall defining a bore having opposite ends, a membrane frangibly connected to the wall and closing the bore, and a pull-ring attached to a surface of the membrane facing one of said ends with which to tear the membrane from the wall, the frangible connection between the membrane and the wall lying in a plane which is inclined to a plane perpendicular to an axis of the bore, and the pull-ring being attached to a peripheral portion of the membrane at a location where the axial height of the bore above the membrane is at a minimum, the pull ring comprising an annular band having an upper edge lying in a radial plane proximate a plane perpendicular to the axis of the bore and a lower edge lying in a plane inclined at a shallow angle with respect to the axis of the bore.

2. A closure in accordance with claim 1, wherein the opposite ends of the bore occupy parallel planes.

3. A closure in accordance with claim 1, wherein the membrane comprises a peripheral portion and a concave central portion.

4. A closure in accordance with claim 3, wherein the concave central portion extends away from one of said ends but does not extend beyond a plane defined by the other of said ends.

5. A closure in accordance with claim 1, wherein the wall defining the bore is strengthened intermediate the membrane and the end opposite said one end.

6. A closure in accordance with claim 1, wherein the bore is of circular cross-section such that a plane perpendicular to the axis of the bore comprises a radial plane.

7. A closure in accordance with claim 1, wherein the frangible connection between the wall and the membrane defines an ellipse.

8. A closure in accordance with claim 1, wherein the bore decreases in internal diameter between said one end and the membrane.

9. A closure in accordance with claim 1, further comprising a cap having a sealing surface, the sealing surface being adapted to be received within one end of the bore to sealingly engage the wall at a location intermediate the membrane and said one end.

* * * * *